US007942268B2

(12) United States Patent
Manca

(10) Patent No.: US 7,942,268 B2
(45) Date of Patent: May 17, 2011

(54) CONTAINER FOR TAKE-AWAY PIZZA OR THE LIKE

(76) Inventor: Silvio Manca, Cortefranca (IT)

( * ) Notice: Subject to any disclaimer, the term of this patent is extended or adjusted under 35 U.S.C. 154(b) by 69 days.

(21) Appl. No.: 12/466,081

(22) Filed: May 14, 2009

(65) Prior Publication Data

US 2010/0122930 A1 May 20, 2010

(51) Int. Cl.
*A45C 11/20* (2006.01)

(52) U.S. Cl. ..... 206/551; 206/511; 229/906

(58) Field of Classification Search ..... 206/551, 206/503, 509, 511, 541, 550, 567, 105, 464, 206/465; 220/368, 324, 326, 555, 556; 229/407, 229/906; 426/115–120, 124, 128
See application file for complete search history.

(56) References Cited

U.S. PATENT DOCUMENTS

| | | | | |
|---|---|---|---|---|
| 3,335,846 | A * | 8/1967 | Mills | 206/551 |
| 3,938,726 | A * | 2/1976 | Holden et al. | 229/406 |
| 4,848,543 | A * | 7/1989 | Doboze | 206/551 |
| 5,076,460 | A * | 12/1991 | Hussell | 220/324 |
| 5,273,174 | A * | 12/1993 | Fisher | 220/4.21 |
| 5,472,139 | A * | 12/1995 | Valdman et al. | 229/906 |
| 5,605,231 | A * | 2/1997 | Borsboom et al. | 206/551 |
| 6,095,324 | A * | 8/2000 | Mullin | 206/551 |
| 6,257,434 | B1 * | 7/2001 | Lizzio | 220/4.23 |
| 7,000,825 | B2 * | 2/2006 | Alexander et al. | 229/906 |

FOREIGN PATENT DOCUMENTS

| | | |
|---|---|---|
| EP | 0989067 | 3/2000 |
| EP | 1857377 | 11/2007 |

* cited by examiner

*Primary Examiner* — Luan K Bui
(74) *Attorney, Agent, or Firm* — Shoemaker and Mattare

(57) ABSTRACT

A container for take-away pizza or the like comprises a first dish-shaped semi-container and a second dish-shaped semi-container comprising a first and a second support portions, respectively, adapted to support the pizza, and means for the mutual releasable connection of the first and the second semi-containers. The first and the second semi-containers are shaped so that, when they are connected, the respective support portions thereof form, together, a pizza seat adapted to internally contain the take-away pizza and, when they are separated, each of them can act as a dish for the pizza through the respective support portion thereof. The first and the second semi-containers are made of a washable material so that the container can be used many times.

11 Claims, 7 Drawing Sheets

CONTAINER FOR TAKE-AWAY PIZZA OR THE LIKE

BACKGROUND OF THE INVENTION

The present invention relates to a container for pizza, particularly for take-away pizza or similar foodstuff.

Containers for take-away pizza are known, in which the pizza is placed once it is removed from the oven of the pizza shop for the transport to the destination where the pizza is to be consumed, for example, the user's house.

The containers for the transport of pizza are usually composed of recycled cardboard die-cut blanks prearranged with fold lines adapted to implement an openable and reclosable box, so that the pizza can be introduced therein and subsequently maintained in a substantially closed environment during transport.

However, such known containers are not free from drawbacks.

Given the configuration thereof, the transported pizzas cannot generally be eaten in the container, but they have to be placed, for example, on a dish. In fact, the cardboard tends to break under the action of a knife cutting through the pizza, which therefore may damage the support upon which the container rests. Furthermore, the closure flap of the container, once it has been opened, laterally projects from the container, substantially doubling the dimensions thereof. Therefore, in order to be able to consume the pizza within the cardboard box, it is necessary to have large areas available, or to fold down the projecting flap underneath the same container (however, with the risk to dirty the container support), or to tear it from the same container, which operation, if it is performed manually, involves the risk that the user gets dirty, or, alternatively, it requires the use of scissors or the like.

A further drawback of the known containers is that they, being made of cardboard, are generally not capable of suitably retain heat, thereby the pizza, once it has reached its destination, it very often is cold, thus it is not tasty anymore.

A further drawback of the known containers is that the cardboard impregnates with oil and with the additional ingredients of the pizza, therefore it cannot be reused. Furthermore, the disposal thereof is troublesome, exactly because the cardboard results to be impregnated with food substances at the end of its use.

Finally, from recent studies, it would seem that the cardboard of which the known take-away containers are made, when it is subjected to the heat of the pizza, releases harmful, when not even carcinogenic, substances for the human body. Such conclusion, even if it is not definite, poses in any event a very serious and absolutely unacceptable problem.

OBJECT AND SUMMARY OF THE INVENTION

Therefore, an object of the present invention is to provide a container for take-away pizzas or the like, which allows transporting the pizza while limiting heat losses.

A further object of the present invention is to provide a container which is also suitable to a comfortable consumption of the pizza therein, without substantial risks to damage the support top of the container or without a high risks for the user to get dirty because of necessary operations on the same container to open it.

A further object of the present invention is to provide a container which can be reused many times, i.e. for the transport of more pizzas, without hygiene problems.

Finally, a further object of the present invention is to provide a container which does not release harmful substances during transport of the pizza.

These and other objects are achieved by a container for take-away pizzas or the like according to claim 1. Each of the dependent claims defines a possible embodiment of the container according to the invention.

BRIEF DESCRIPTION OF THE DRAWINGS

In order to better understand the convenience and efficiency of the invention, some exemplary, non-limiting embodiments thereof will be described below, with reference to the annexed Figures, in which.

DETAILED DESCRIPTION OF THE PREFERRED EMBODIMENTS

Figure 1:
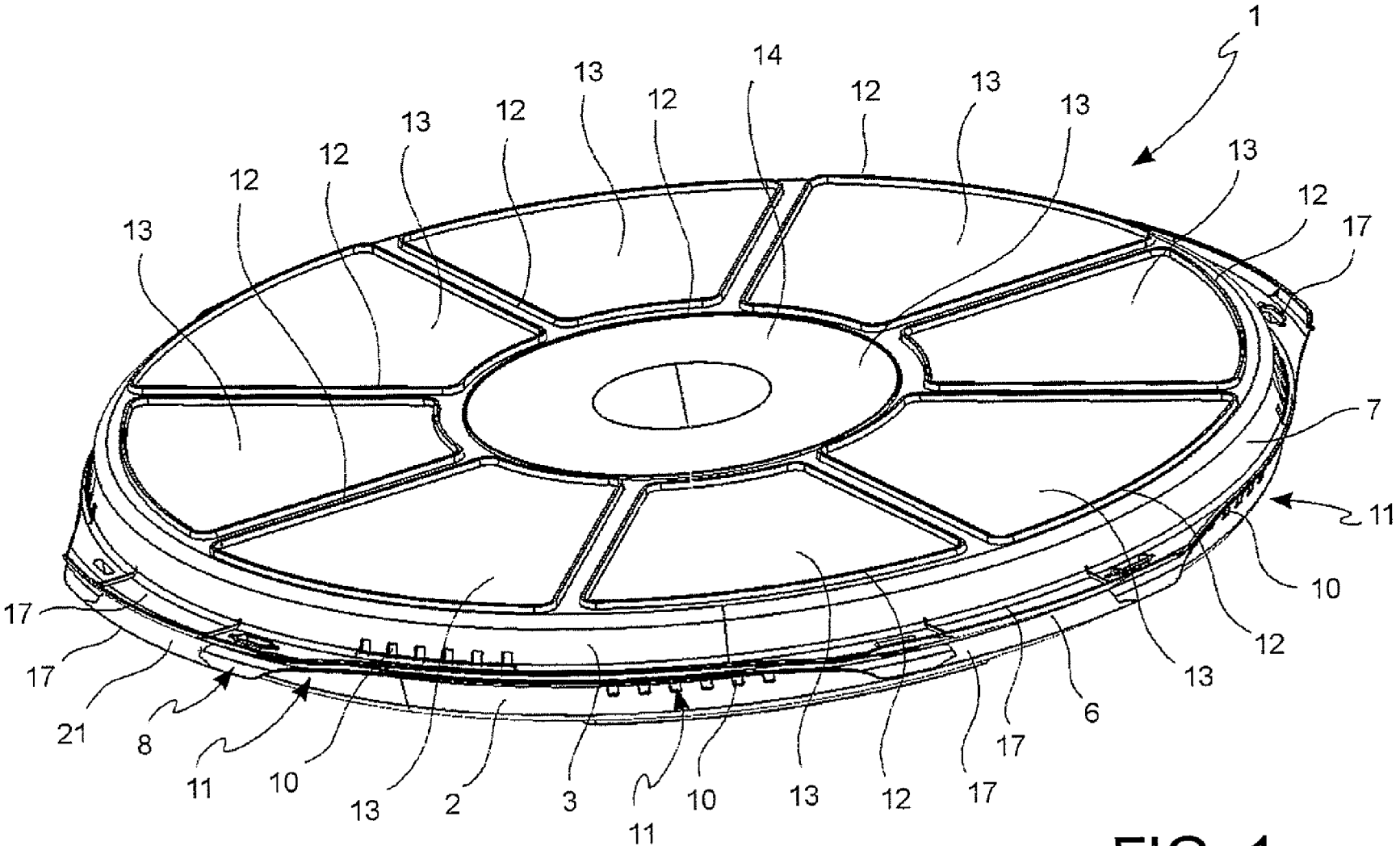
FIG. 1 is a perspective view of a container according to the present invention.
Figure 2:
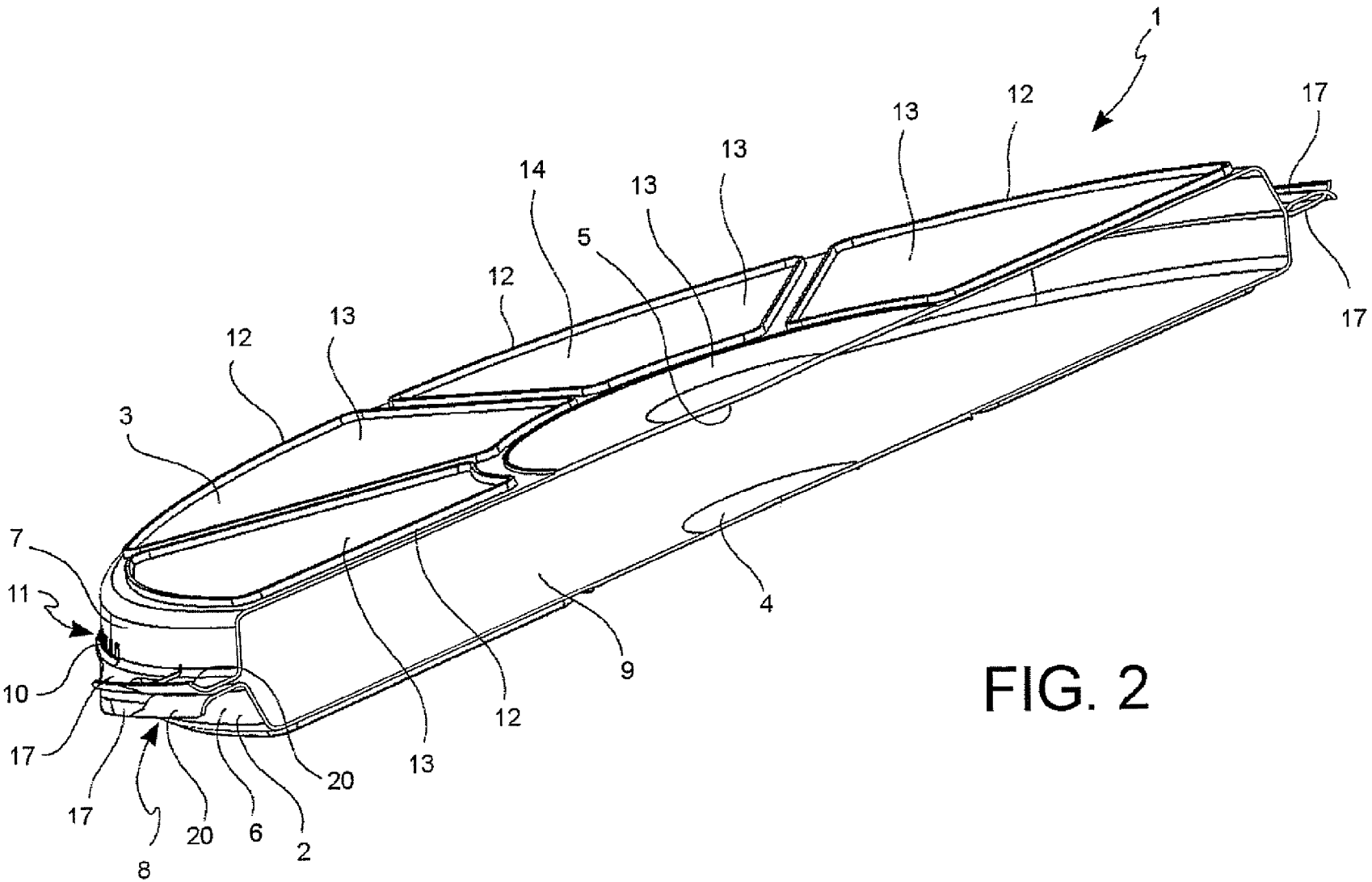
FIG. 2 is a sectional perspective view of the container in FIG. 1.
Figure 3:
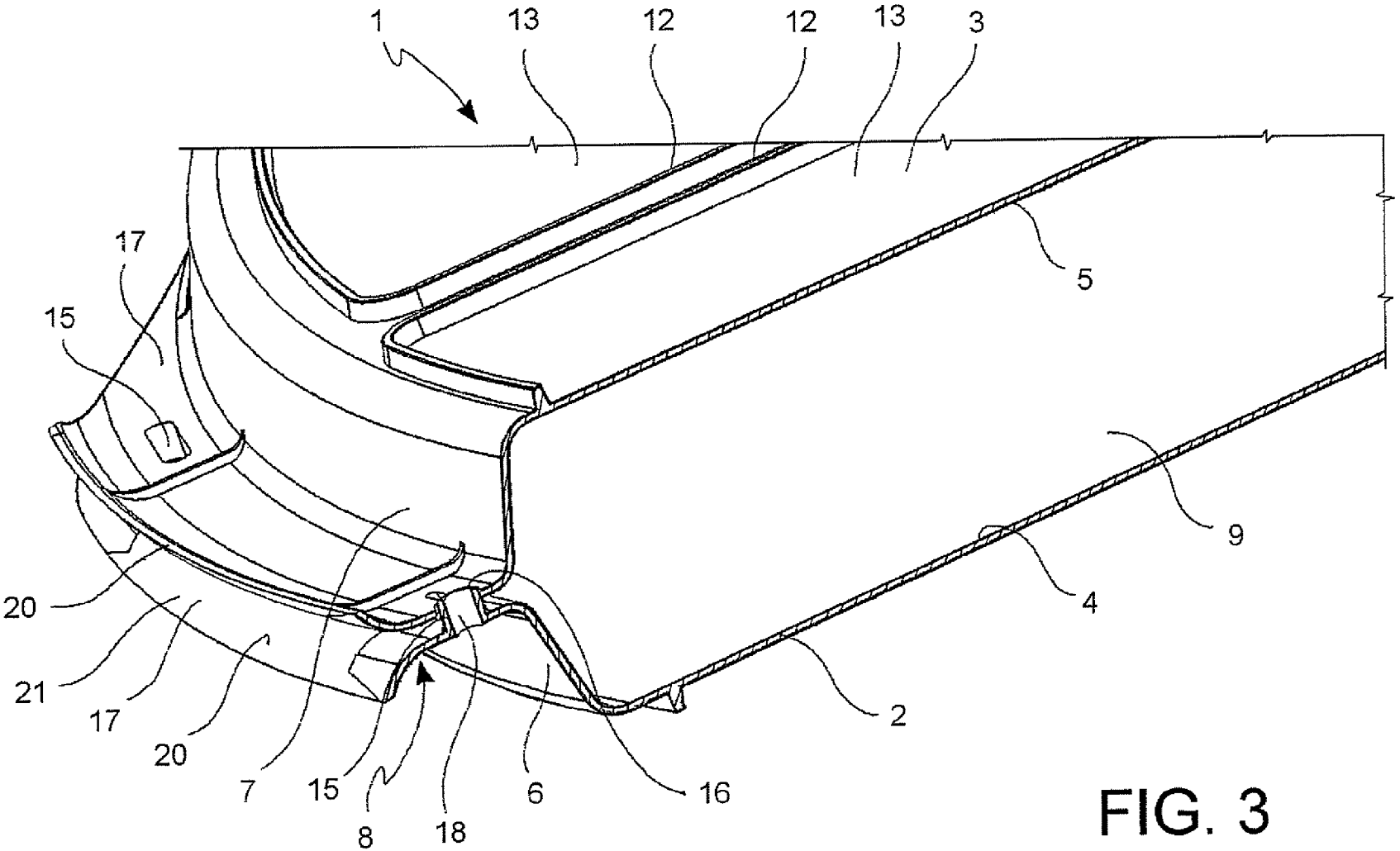
FIG. 3 is a sectional perspective view of a detail of the container in FIG. 2.
Figure 4:
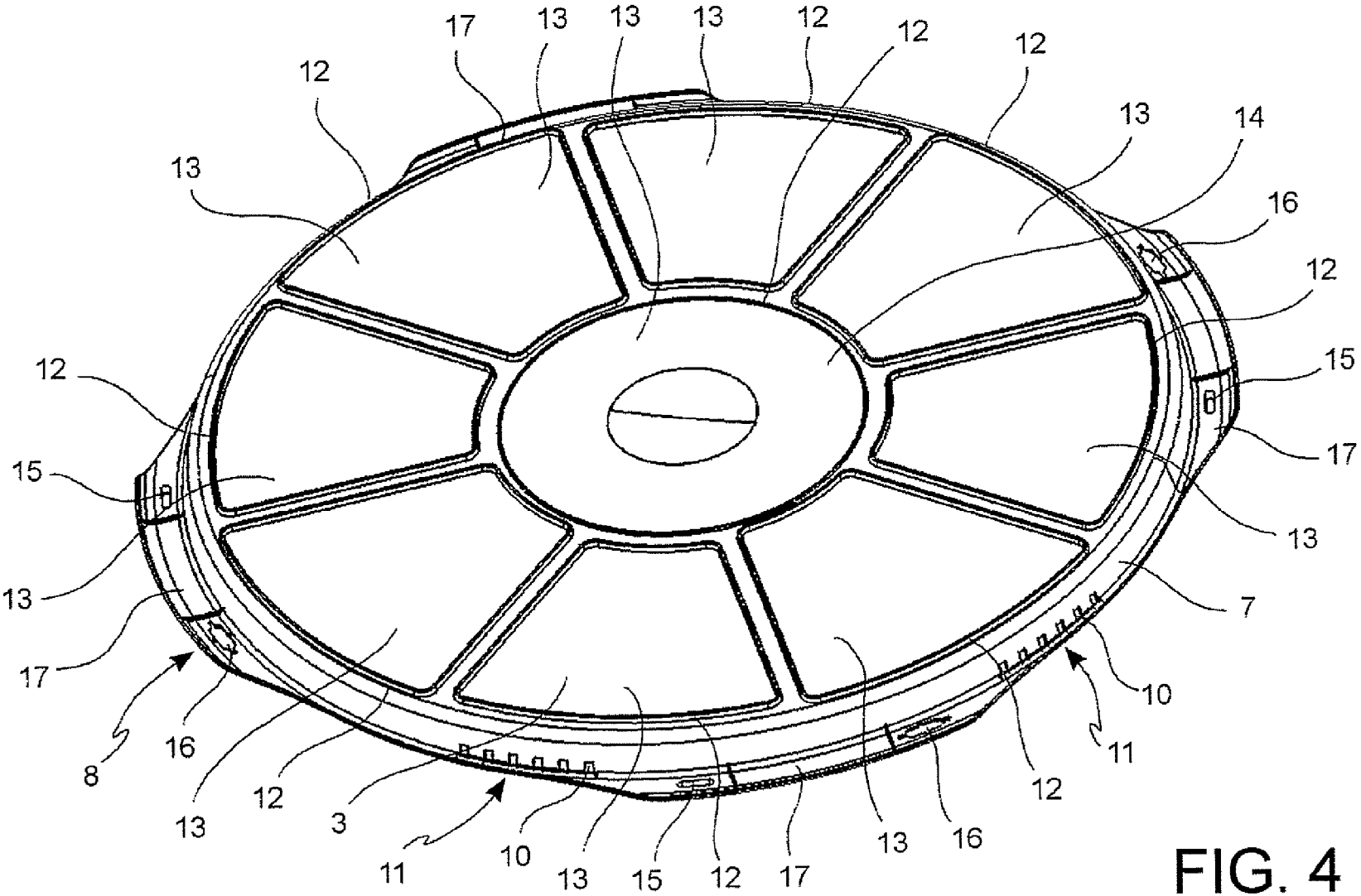
FIG. 4 is a perspective view of a portion of the container in FIG. 1.
Figure 5:
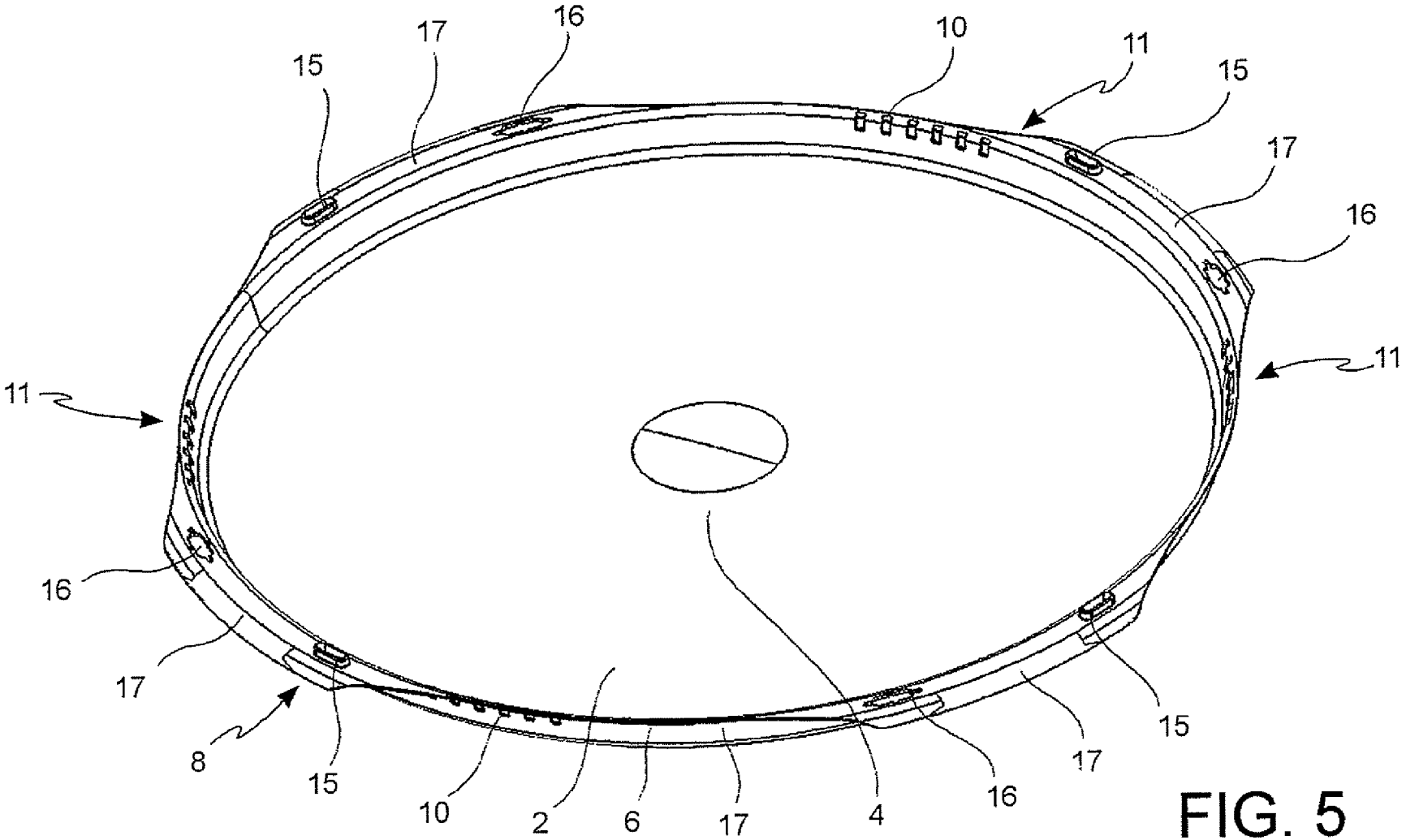
FIG. 5 is a perspective view of a further portion of the container in FIG. 1.

With reference to the Figures, a container according to the present invention is indicated with 1. The container 1 is mainly intended to the transport of take-away pizzas or similar foodstuffs. For example, the container 1 is particularly adapted to transport pizza from the pizza shop to the end consumption destination, for example, the user's house.

The container 1 comprises a first semi-container 2 and a second semi-container 3. The two semi-containers 2 and 3 are dish-shaped and comprise a first 4 and a second 5 support portions, respectively, adapted to support the pizza (not shown in the Figures). The support portions 4 or 5 are preferably substantially planar, and they can have smooth or at least partially knurled surfaces, so as to limit the movements of the pizza when it is arranged in the container 1. According to a possible embodiment, the semi-containers 2 and 3 have a first 6 and a second 7 retaining side edges, respectively, which are adapted to avoid that the pizza comes out of the support portions 4 and 5, respectively, when it is supported thereby. In this manner, each of the semi-containers is capable of acting as a dish independently from the other semi-container.

The container 1 comprises means 8 for the mutual connection of the first 2 and the second 3 semi-containers. Such connection means 8 are advantageously releasable, so that the first 2 and the second 3 semi-containers can be connected one to the other in a reversible manner, i.e. connected and unconnected many times, if needed.

When the first 2 and the second 3 semi-containers are mutually unconnected, each of them is capable, independently from the other, to act as a dish for the take-away pizza, as stated before.

Instead, when the first 2 and the second 3 semi-containers are mutually connected through the connection means 8, the respective support portions 4 and 5 thereof come to be in such positions one to the other as to form a pizza seat 9 adapted to hold the take-away pizza. Particularly, advantageously, the first 4 and the second 5 support portions are shaped so that the pizza seat 9 substantially wraps the pizza inserted in the container 1 when the first 2 and the second 3 semi-containers are mutually connected.

Advantageously, the first 2 and the second 3 semi-containers are made of a washable material, for example, with water, optionally with the addition of detergents. In this manner, the container can be used more than once, for example, for the transport of more take-away pizzas in different circumstances. The material of which the first 2 and the second 3 semi-containers are made is preferably selected from the group of the plastic materials, still more preferably, such material is polypropylene.

The thus-configured container 1 allows obtaining a number of advantages.

A first advantage is that, given the configuration of the first 4 and the second 5 support portions, the pizza seat which is formed when the two semi-containers are mutually connected has such a configuration as to wrap the pizza, and this allows, thanks to the use of a plastic material, achieving the additional effect of a reduced loss of heat of the same pizza.

Furthermore, the dish-like configurations of the first 2 and the second 3 semi-containers make so that the latter can be also used for the consumption of pizza, without needing to transfer the pizza from the container to a special dish. The semi-container of the first and the second semi-containers which does not act as a dish, but only acts as a lid for the container during transport of the pizza, can be easily removed and put aside, without requiring complex operations, or without taking up space during consumption.

Finally, the use of a plastic material, such as polypropylene, overcomes the problem of a release of harmful substances which the recycled cardboard, of which the containers according to the prior art are made, is suspected to be prone to.

In accordance with a possible embodiment, the first and the second semi-containers 2 and 3 have circular profiles, and also their respective first 4 and second 5 pizza support portions preferably have circular shapes. In fact, the circular shape is that most commonly used by pizza cooks when preparing pizzas. However, of course, it is possible to provide also for different shapes for the transport of pizzas of similar shapes. For example, it is possible to provide for containers with a squared, rectangular, or oval profile. Still more preferably, the respective retaining side edges 6 and 7 will also be of the same shape. With reference to the most common shape for a pizza, the circular shape, the container 1, when it is closed (i.e. when the first and the second semi-containers are mutually connected) has, on the whole, a substantially disk-like shape (see, for example, FIG. 1).

Advantageously, the first and/or the second semi-containers 2 and 3 comprise one or more openings 10 adapted to make the pizza seat 9 to communicate with the exterior of the container 1, when the latter is closed with a pizza therein. The windows 10 have as the main function thereof to allow the escape of the fumes coming from the hot pizza from the pizza seat 9 outwardly of the container 1. The windows 10 can be variously configured and arranged. According to a possible embodiment, the first and the second semi-containers comprise one or more series 11 of windows 10, each comprising a plurality of windows 10. Such series of windows 10 are preferably arranged along the side edges 6 and 7 of the first and the second semi-containers 2 and 3. According to a possible embodiment, each of the semi-containers 2 and 3 includes four of the series 11 of windows 10, each of which preferably comprises six windows 10. Still more preferably, the series of windows 11 of the first 2 and the second 3 semi-containers, respectively, are so arranged as to result to be angularly offset (with reference to the previously described disk-like shape of the container) when the container 1 is closed.

The windows 10 may have a number of shapes, but they preferably are of a squared or rectangular shape.

The semi-containers preferably have a thin configuration, so as to reduce the amount of material which is required for the formation thereof, therefore the implementation costs. Therefore, with the aim of stiffening the respective support portions 4 and 5, the semi-containers advantageously comprise reinforcing ribs 12.

Such reinforcing ribs 12 may have a number of configurations and arrangements. They are preferably arranged on the outer side of the semi-containers, i.e. on the side opposite the side which is needed to define the pizza seat 9. In this manner, the ribs 12 do not represent a hindrance to the positioning of the pizza on the support portions 4 and 5. In accordance with a possible embodiment, the reinforcing ribs 12 are so shaped as to form closed curves, which implement as many reinforcing areas 13 of the support portions 4 and 5. For example, the reinforcing ribs 12 can be shaped so that the reinforcing areas 13 have the shape of circle sectors put in a side-by-side relationship according to the circumferential direction of the container. In addition, a further central reinforcing area 14 can be provided, which is arranged surrounded by the above-mentioned circle sector-shaped reinforcing areas.

As stated before, the reversible connection of the first 2 and the second 3 semi-containers 3 is made possible by the releasable connection means 8. Advantageously, such releasable connection means 8 comprise pressure connection means. Particularly, according to a possible embodiment, the pressure connection means comprise pins 15 and holes 16, in which the pins 15 are suitable to insert in the holes 16 by interference. In order to ensure the coupling, the pins 15 of the first semi-container 2 are inserted by interference in corresponding holes 16 of the second semi-container 3, and/or vice versa. Preferably, both the first 2 and the second 3 semi-containers are provided with both one or more pins 15 and one or more pins 16.

In accordance with an embodiment, the first 2 and the second 3 semi-containers comprise a plurality of connection areas 17 in which the mutual connection thereof can take place. Such connection areas 17 are preferably arranged along the first 6 and second 7 side edges thereof, respectively, so that a connection area of the second semi-container 3 corresponds to a connection area of the first semi-container 2. Preferably, the connection areas 17 are in the number of four, and are arranged mutually angularly equispaced (in relation to the circular profile of the semi-containers).

Advantageously, each connection area 17 comprises at least one of said pins 15 or holes 16. According to a preferred embodiment, each connection areas 17 includes a pin 15 and a hole 16, so that the mutual connection of the first 2 and the second 3 semi-containers can take place for any type of relative orientation between the connection areas 17 of the first 2 and the second 3 semi-containers. It shall be apparent that alternative arrangements of the holes 16 and the pins 15 in the connection areas 17 can be provided for. For example, according to an embodiment not shown in the Figures, the pins 15 and the holes 16 can be arranged alternating on successive connection areas 17. In this manner, the coupling of the first 2 and the second 3 semi-containers can take place only for some relative positions thereof, i.e. when the pin arranged on the connection area of one of the two semi-containers matches with one hole of the corresponding connection area of the other one of the two semi-containers.

The pins 15 and the holes 16 may have several configurations. Advantageously, the pins 15 are shaped so that the interference with the hole 16 increases as the pin 15 is inserted into the hole 16. Particularly, the pins 15 have a decreasing section according to the insertion direction of the pin in the hole, i.e. they have a smaller section at the upper end, which is the pin first portion entering the hole, and a larger section at the base. Advantageously, with the aim of keeping the container structure light-weight, the pins 15 have through openings 18 therein.

Figure 6:
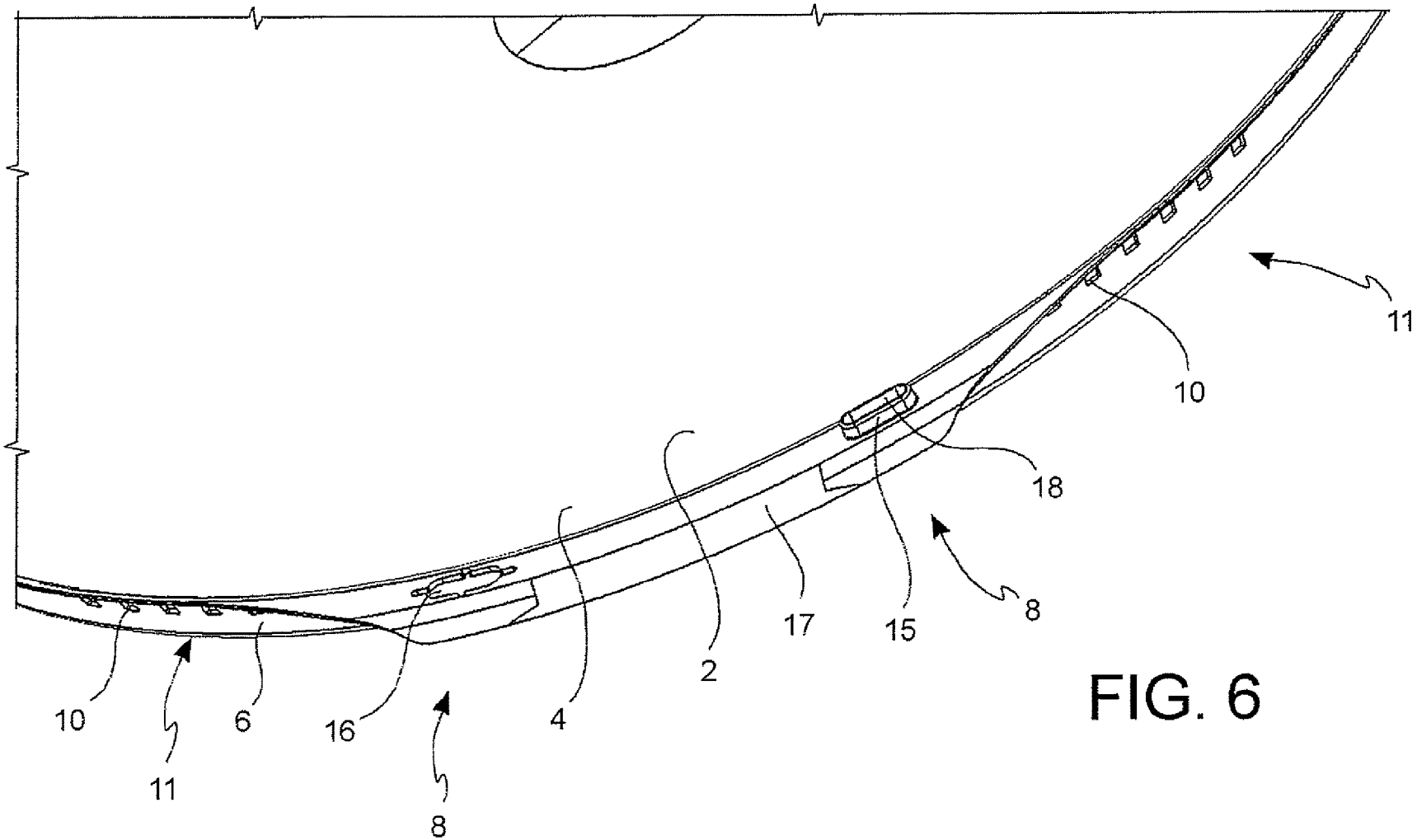
FIG. 6 is a perspective view of a detail of the portion of the container in FIG. 5.

Also the shapes of the pins 15 and holes 16 sections, which are the parts thereof at least partially contacting when the holes and the pins are in an interference condition, may have several configurations. According to a possible embodiment, they have a preferably end-rounded extended shape (see, for example, FIG. 6). It shall be apparent that different configurations are possible, for example, circular, rectangular, polygonal, or the like.

In accordance with an embodiment, the connection areas 17 comprise tongues 19 radially projecting from the semi-containers 2 and 3, particularly from the respective first 6 and second 7 side edges thereof. The pins 15 and the holes 16 are advantageously associated to such tongues 19. Still more preferably, the tongues 19 form the pins 15 and the holes 16.

The tongues 19 have the advantageous function of making the separation of the first 2 and the second 3 semi-containers for the opening of the container 1 easy. In fact, it is sufficient that the user gets hold of two corresponding tongues 19 of the first 2 and the second 3 containers and moves them away in order that the pin 15 and the hole 16 arranged on those tongues disengage. At this point, the first 2 and the second 3 semi-containers are partially separated, and by proceeding to exert a moving apart action thereupon, it is possible to divide also the remaining pins 15 and holes 16 which are engaged one to the other.

According to a possible embodiment, the tongues 19 have folded end portions 20, of such a shape as to establish a space 21 for the insertion of the fingers of the user's hands between the corresponding tongues of the first and the second semi-containers when these are connected. The provision of the end portions makes the separation of the first 2 and the second 3 semi-containers still easier via the manual action on the same tongues.

Figure 7:
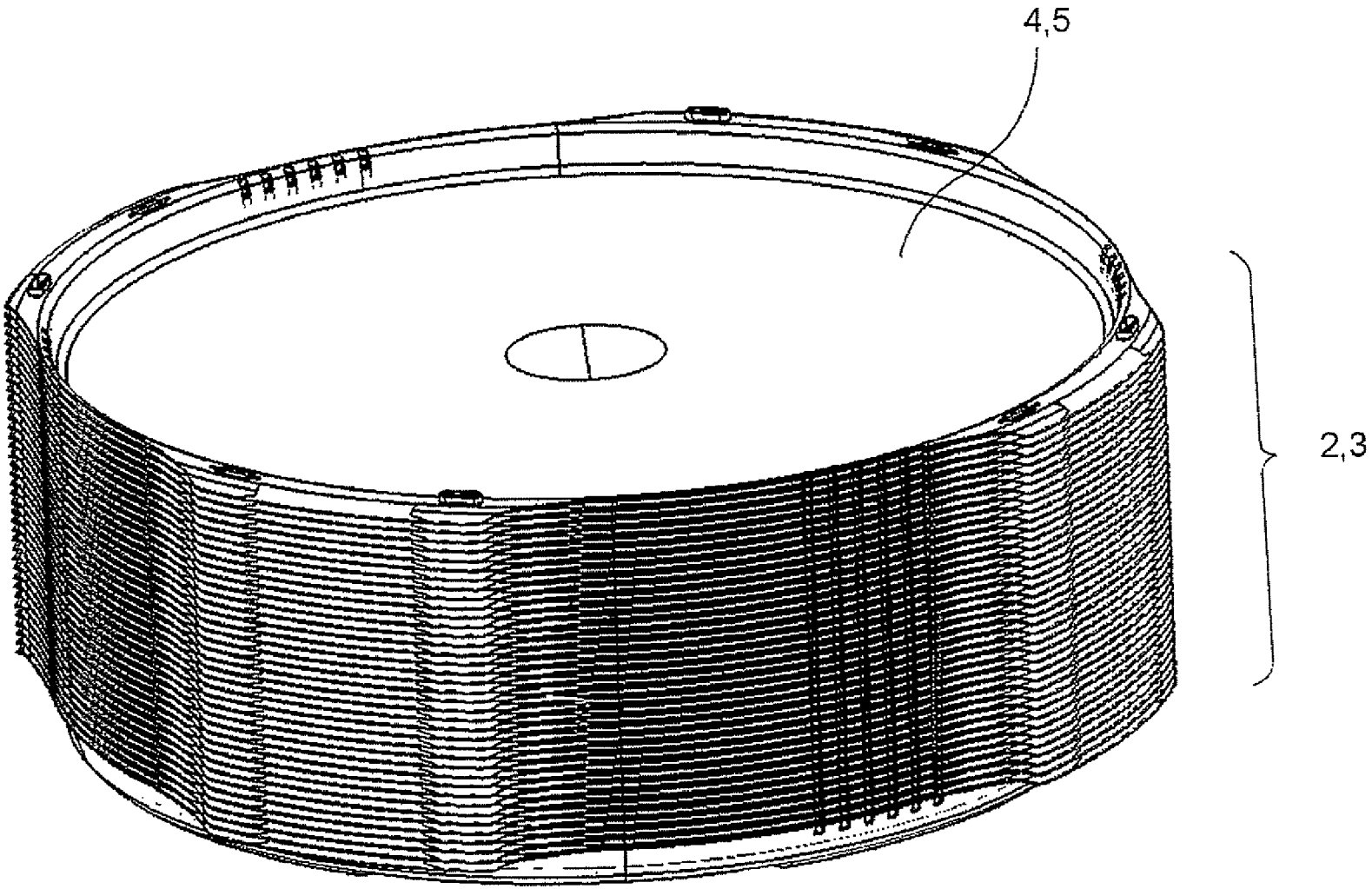
FIG. 7 is a perspective view of a plurality of container portions in FIG. 4 and/or in FIG. 5, in a particular condition of use.

Advantageously, the first 2 and the second 3 semi-containers have such shapes as to be mutually stackable (FIG. 7). This makes the transport thereof when they are empty, as well as the storing thereof, extremely easy, for example, in the pizza shop where the take-away pizzas are produced, to be transported with the not very bulky container 1.

Still more advantageously, the first 2 and the second 3 semi-containers are identical. In this manner, their functions as a container dish and lid make the semicontainers completely interchangeable. Therefore, the pizza cook can, starting from a stack of semi-containers, use the semi-container which he/she finds on top of the stack without distinction as a dish (in the case he/she has to place the pizza in the container), or as a lid (in the case he/she has to close the container in which he/she has previously placed the pizza).

From the description given above, those skilled in the art will be able to appreciate how the container according to the present invention results to be particularly convenient not only for the transport, but also for the consumption of take-away pizzas. In fact, once it has been opened, the container looks like a dish, and it does not require transferring the pizza. Furthermore, the container lid can be completely detached from the dish and put aside in a place where it does not inconvenience the consumption of the pizza. Such operation results to be smooth and with a low risk for the user to get dirty during the container opening operation.

Furthermore, those skilled in the art will be able to appreciate how, given the configuration thereof, and the preferred materials of which it is manufactured, the container ensures a reduced loss of heat, therefore it ensures that the pizza arrives still suitably hot to the place of consumption.

Furthermore, the preferred materials that are used in the container according to the present invention, particularly plastic materials, being washable, allow the removal of pizza residues at the end of the consumption. Therefore, the container can be reused many times by the user. For example, the user who wants a take-away pizza can personally take the previously used container to the pizza shop to take away and transport a new pizza.

Finally, the container according to the present invention does not have the problem mentioned with reference to the known containers, made of recyclable cardboard, for which the suspect does exist that they release harmful, maybe even carcinogenic, substances for the human body.

To the above-described embodiments of the container according to the present invention, those skilled in the art, with the aim of meeting specific, contingent needs, will be able to make a number of additions, modifications, or replacements of elements with other functionally equivalent ones, however without departing from the scope of the annexed claims.

What is claimed is:

1. A container for take-out pizza, said container comprising a first dish-shaped semi-container and a second dish-shaped semi-container comprising a first and a second support portions, respectively, adapted to support said pizza, and means for the mutual releasable connection of said first and second semi-containers, wherein the first and the second semicontainers are each shaped so that the respective support portion thereof forms a dish for said pizza and, when the semicontainers are connected, the respective support portions thereof form, together, a pizza seat adapted to internally contain said pizza, wherein said first and second semicontainers are made of a washable material so that the container can be used many times, and wherein said first and second semicontainers comprise a plurality of connection areas comprising said releasable connection means, said connection areas being arranged along an edge of said first and second semi-containers and said connection areas comprising tongues radially projecting from said first and second semicontainers with folded end portions, so as to make the manual separation of the first and the second semicontainers easier when the semicontainers are interconnected by the connection means.

2. The container according to claim 1, wherein said first and second semi-containers are made of plastic material.

3. The container according to claim 1, wherein said first and second semi-containers are made of polypropylene.

4. The container according to claim 1, wherein said first and second semi-containers and the respective first and second support portions thereof have a circular profile.

5. The container according to claim 1, wherein said first and/or second semi-containers comprise an opening for venting fumes from the pizza when it is housed in said pizza seat.

6. The container according to claim 1, wherein said first and/or second semi-containers comprise reinforcing ribs adapted to stiffen the respective support portions thereof.

7. The container according to claim 1, wherein said releasable connection means comprise pressure connection means.

8. The container according to claim 7, wherein said pressure connection means comprise pins adapted to seat in corresponding holes by interference.

9. The container according to claim 1, wherein each of said connection areas of said first and said second semi-containers comprises at least one pin and at least one hole.

10. The container according to claim 1, wherein said first and second semi-containers are so shaped as to be stackable one upon the other and with other first and/or second semi-containers.

11. The container according to claim 1, wherein said first and second semi-containers are identical.

* * * * *

UNITED STATES PATENT AND TRADEMARK OFFICE

CERTIFICATE OF CORRECTION

PATENT NO. : 7,942,268 B2
APPLICATION NO. : 12/466081
DATED : May 17, 2011
INVENTOR(S) : Manca It is certified that error appears in the above-identified patent and that said Letters Patent is hereby corrected as shown below:

TITLE PAGE,
After
(65) Prior Publication Data
US 2010/0122930 A1 May 20, 2010

Please insert:
-- (30) Foreign Application Priority Data
Nov. 19, 2008 (IT).....MI2008U000382 --

Signed and Sealed this
Fifth Day of July, 2011

David J. Kappos
*Director of the United States Patent and Trademark Office*